US008918044B2

(12) United States Patent
Takematsu et al.

(10) Patent No.: US 8,918,044 B2
(45) Date of Patent: Dec. 23, 2014

(54) IMAGE HEATING APPARATUS AND RECORDING MATERIAL FEEDING APPARATUS

(75) Inventors: Koji Takematsu, Abiko (JP); Kazuaki Aoki, Moriya (JP); Shouhei Takeda, Toride (JP); Yasuo Nami, Toride (JP); Naoyuki Yamamoto, Kashiwa (JP); Masahiro Nawa, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 132 days.

(21) Appl. No.: 13/530,812

(22) Filed: Jun. 22, 2012

(65) Prior Publication Data

US 2012/0328342 A1 Dec. 27, 2012

(30) Foreign Application Priority Data

Jun. 24, 2011 (JP) ..... 2011-140349

(51) Int. Cl.
*G03G 15/20* (2006.01)
*G03G 15/01* (2006.01)

(52) U.S. Cl.
CPC ..... *G03G 15/2053* (2013.01); *G03G 15/0189* (2013.01); *G03G 2215/0129* (2013.01)
USPC ..... 399/330; 399/320

(58) Field of Classification Search
USPC ..... 399/122, 320, 330, 333
See application file for complete search history.

(56) References Cited

U.S. PATENT DOCUMENTS 5,659,848 A * 8/1997 Jeon ..... 399/122
7,196,296 B2 3/2007 Yamamoto
7,199,339 B2 4/2007 Shirakata et al.
7,205,514 B2 4/2007 Suzuki et al.
7,238,924 B2 7/2007 Kondo et al.
7,268,326 B2 9/2007 Yamamoto et al.
7,268,327 B2 9/2007 Yamamoto et al.
7,271,371 B2 9/2007 Takematsu et al.
7,280,794 B2 * 10/2007 Fujimoto ..... 399/328
7,319,210 B2 1/2008 Hosoi et al.
7,397,017 B2 7/2008 Hosoi et al.
7,433,643 B2 * 10/2008 Matsuno et al. ..... 399/333
7,442,905 B2 10/2008 Wakahara et al.
7,462,804 B2 12/2008 Shirakata et al.
7,465,906 B2 12/2008 Wakahara et al.
7,539,449 B2 5/2009 Aoki
7,657,217 B2 2/2010 Wakahara et al.
7,693,473 B2 * 4/2010 Ardery et al. ..... 399/329
7,756,460 B2 7/2010 Matsuno et al.

(Continued)

FOREIGN PATENT DOCUMENTS

JP 10026897 A * 1/1998 ..... G03G 15/20
JP 2007-57643 A 3/2007
JP 2007-57644 A 3/2007
JP 2009-204731 A 9/2009

*Primary Examiner* — David Gray
*Assistant Examiner* — Francis Gray
(74) *Attorney, Agent, or Firm* — Fitzpatrick, Cella, Harper & Scinto

(57) ABSTRACT

An image heating apparatus includes a hollow image heating roller having a through hole at one axial end portion side thereof; a bearing fitted around the roller; a heat insulating bush fitted around the roller between the roller and the bearing; a retaining ring for preventing the heat insulating bush from moving relative to the roller; an annular spacer provided between the heat insulating bush and the retaining ring, the annular spacer being provided with an inwardly protruded key portion engageable with the through hole.

22 Claims, 12 Drawing Sheets

(56) References Cited

U.S. PATENT DOCUMENTS

| | | | |
|---|---|---|---|
| 8,099,008 | B2 | 1/2012 | Nakase et al. |
| 2007/0048047 | A1 | 3/2007 | Matsuno et al. |
| 2009/0022528 | A1 | 1/2009 | Matsuno et al. |
| 2011/0091225 | A1 | 4/2011 | Yamamoto |
| 2011/0091230 | A1 | 4/2011 | Yamamoto |
| 2012/0118877 | A1 | 5/2012 | Nakase et al. |

* cited by examiner (a)

(b)

(a)

(b)

(a)

(b)

(a)

(b)

IMAGE HEATING APPARATUS AND RECORDING MATERIAL FEEDING APPARATUS

FIELD OF THE INVENTION AND RELATED ART

The present invention relates to an image heating apparatus for heating an image formed on recording medium, and a recording material (medium) feeding (conveying) apparatus which heats the recording medium while feeding recording medium.

As examples of an image heating apparatus, a fixing apparatus for fixing an unfixed image formed on recording medium, a gloss altering apparatus for improving in glossiness an image formed on recording medium, and the like, may be listed.

As examples of a recording medium conveying apparatus, an uncurling apparatus for improving recording medium in appearance, a recording medium drying apparatus for heating recording medium to dry the recording medium before the formation of an image on the recording medium.

These image heating apparatus and recording medium conveying apparatus can be used by a copying machine, a printer, a facsimile machine, a multifunction machine capable of performing two or more functions of the preceding equipments, and the like, for example.

Generally speaking, an electrophotographic image forming apparatus is structured to apply heat and pressure to fix a toner image formed on recording medium through an electrophotographic process (Japanese Laid-open Patent Application 2009-204731).

Referring to FIG. 3, Japanese Laid-open Patent Application 2009-204731 discloses a structural arrangement for the lengthwise end portions of an image heating roller (image heating member). More concretely, the image heating roller 200 disclosed in this patent application is structured so that it can be assembled by fitting a pair of bearings 300, a pair of thermal insulation bushings 400, and a pair of retaining rings 500 (ring-shaped regulating member) 500 around its lengthwise end portions, one for one, in the listed order.

Incidentally, the retaining ring 500 is shaped so that its sections (two) protrude a preset distance toward the center of the ring 500. The inwardly protruding sections of the ring 500 fit into the two through holes 201, one for one, with which the image heating roller 200 is provided. Thus, the thermal insulation bushing 400 is prevented by the retaining ring 500 from sliding on the image heating roller 200 in the thrust direction of the image heating roller 200 and falling off from the image heating roller 200.

However, the image heating apparatus disclosed in Japanese Laid-open Patent Application 2009-204731 is structured so that the retaining ring 500, which rotates with the image heating roller 200, rubs against the thermal insulation bushing 400. Therefore, it is possible that retaining ring 500 will unintendedly disengage from the through holes 201 of the image heating roller 200.

This possibility is greater in the case of an image heating roller structured so that the inwardly protruding portions of the retaining ring 500 cannot be made to enter the image heating roller 200 through the through hole 201 by a substantial length.

Thus, the inventors of the present invention thought of placing a spacer which freely rotates around the image heating roller 200, between the thermal insulation bushing and retaining ring. However, the further studies of this idea by the inventors revealed that even if a spacer such as the one described above is placed between the thermal insulation bushing and retaining ring, there is a small possibility (ignorably small possibility) that the inwardly protruding portions of the retaining ring come out of the through holes of the image heating roller, because the retaining ring is allowed to rub the spacer.

The issue described above is present also in the case of such a recording medium conveyance roller (recording medium conveying member) that heats recording medium while conveying recording medium.

SUMMARY OF THE INVENTION

The primary object of the present invention is to provide an image heating apparatus, the retaining rings of which do not disengage from the image heating roller.

Another object of the present invention is to provide an image heating apparatus, the ring-shaped regulating members of which do not disengage from the image heating roller.

Another object of the present invention is to provide a recording medium conveying apparatus, the ring-shaped regulating members of which do not disengage from the recording medium conveying member.

According to an aspect of the present invention, there is provided an image heating apparatus comprising a hollow image heating roller having a through hole at one axial end portion side thereof; a bearing fitted around said image heating roller; a heat insulating bush fitted around said image heating roller between said image heating roller and said bearing; a retaining ring for preventing said heat insulating bush from moving relative to said image heating roller in the axial direction; an annular spacer provided between said heat insulating bush and said retaining ring, said annular spacer being provided with an inwardly protruded key portion engageable with the through hole.

According to another aspect of the present invention, there is provided an image heating apparatus comprising a hollow cylindrical image heating member having a through hole at one end portion side with respect to an axial direction thereof; a bearing member fitted around said image heating member; a heat insulating member fitted around said image heating member between said image heating member and said bearing member; an annular preventing member for preventing said heat insulating member from moving relative to said image heating member in the axial direction, said annular preventing member being provided with a inwardly protruded portion engageable with said through hole; an annular spacer member provided between said heat insulating member and said annular preventing member, said annular spacer member being provided with an inwardly protruded engaging portion engageable with said through hole.

According to another aspect of the present invention, there is provided a recording material feeding device comprising a recording material feeding member having a through hole at one end portion side with respect to an axial direction thereof; a bearing member fitted around said recording material feeding member; a heat insulating member fitted around said recording material feeding member between said recording material feeding member and said bearing member; an annular preventing member for preventing said heat insulating member from moving in the axial direction relative to said recording material feeding member, said annular preventing member being provided with an inwardly projected portion engageable with the through hole; an annular spacer member provided between said heat insulating member and said annular preventing member, said annular spacer member being provided with an inwardly protruded engaging portion engageable with said through hole.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the embodiments of the present invention are described in detail with reference to the appended drawings. Not only is the present invention applicable to the image heating apparatus in the following embodiments of the present invention, but also, image heating apparatuses which are partially or entirely different in structure from those in the following embodiments, as long as they are structured so that a fixation roller bearing is precisely held to each of the lengthwise end portions of the thin-walled fixation roller by a C-shaped retaining ring, with the presence of a spacer between the C-shaped retaining ring and fixation roller bearing.

That is, the present invention is applicable to any image heating apparatus, the heating nip of which is formed by placing its pressure applying rotational member to its fixation roller (image heating roller), regardless of whether the pressure applying rotational member is in the form of a belt or roller, and also, regardless of whether the method for heating a fixation roller is such a method that uses electromagnetic induction (which will be described later), or a method that uses radiant heat from a halogen heater or the like. Further, the present invention is applicable to any image heating apparatus, regardless of the type of the image forming apparatus by which the image heating apparatus is employed, that is, regardless of the charging method, exposing method, and developing method of the image forming apparatus, regardless of whether the image forming apparatus is of the so-called tandem type or single drum type, regardless of whether the image forming apparatus is of the intermediary transfer type or direct transfer type (whether recording medium is sheet or roll of recording medium). In the following description of the embodiments of the present invention, only the portions of the image forming apparatus, which are primarily related to the formation and transfer of a toner image are described. However, not only is the present invention applicable to the image forming apparatuses in the following embodiments of the present invention, but also, various printers, copying machines, facsimile machines, which are combinations of one of the image forming apparatuses in the following embodiments of the present invention, and additional equipments and frames. Further, the present invention is also applicable to various multifunction apparatuses capable of performing two or more functions of the preceding image forming apparatuses. That is, the present invention is applicable in the various fields of image formation.

<Image Forming Apparatus>

Figure 1:
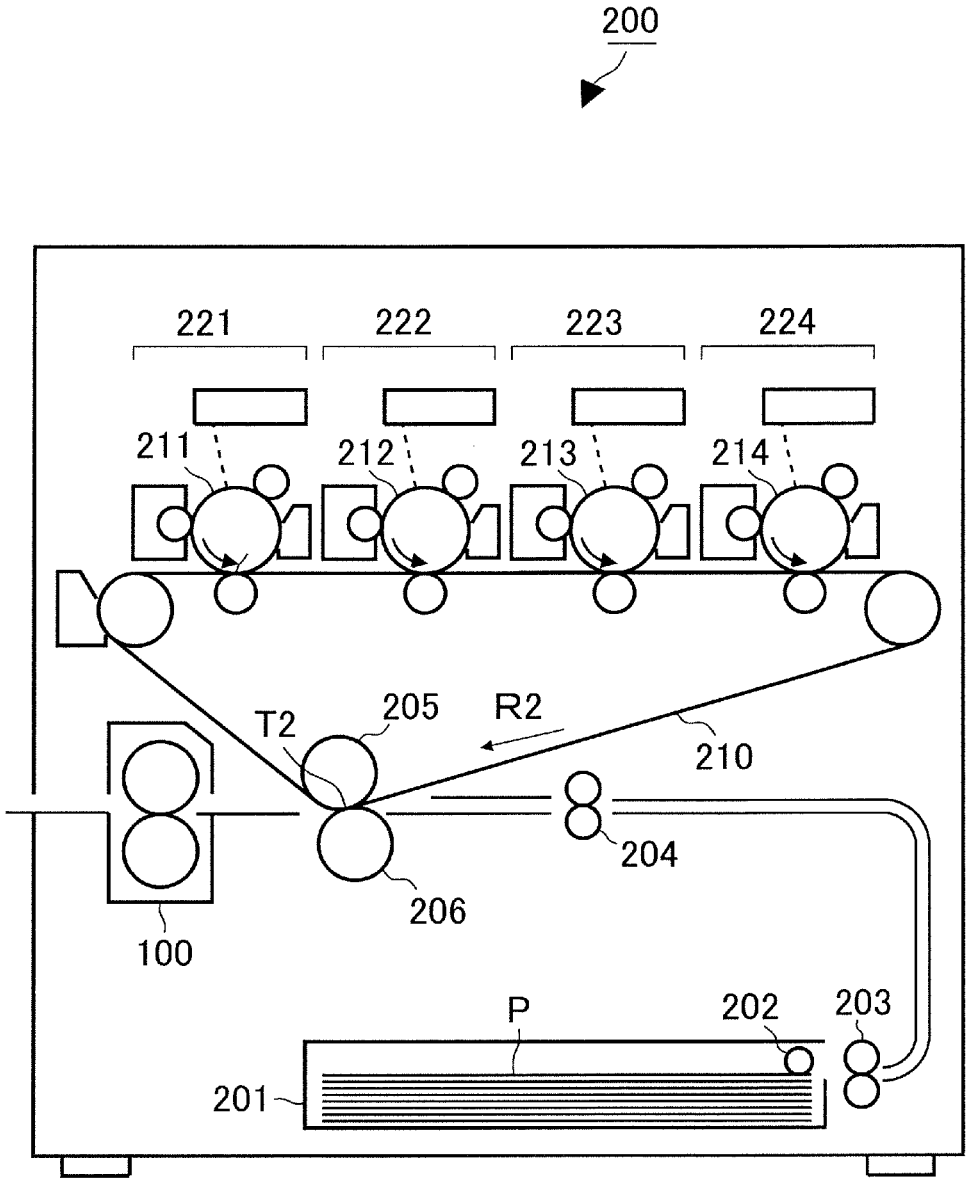
FIG. 1 is a schematic sectional view of the image forming apparatus in the first embodiment of the present invention, and shows the general structure of the apparatus.

FIG. 1 is a drawing for describing an example of a typical image forming apparatus to which the present invention is applicable. The image forming apparatus 200 shown in FIG. 1 is a full-color printer of the so-called tandem type, and also, of the so-called intermediary transfer type. That is, it has yellow, magenta, cyan and black image forming stations 221, 222, 223 and 224, respectively, and an intermediary transfer belt 210. The image forming stations, 221, 222, 223 and 224 are aligned along the intermediary transfer belt 210. They are virtually the same in structure, although they are different in the color of the toner which their developing device uses.

In the image forming station 221, a yellow toner image is formed on a photosensitive drum 221, and is transferred onto the intermediary transfer belt 210. In the image forming station 222, a magenta toner image is formed on a photosensitive drum 222 through a process similar to the one used in the image forming station 221, and is transferred onto the intermediary transfer belt 210. In the image forming stations 223 and 224, a cyan toner image and a black toner image are formed on photosensitive drums 223 and 224, respectively, through a process similar to the one used in the image forming station 221, and are transferred onto the intermediary transfer belt 210.

After the transfer of the four monochromatic toner images, different in color, onto the intermediary transfer belt 210, the monochromatic toner images are conveyed to the secondary transfer station T2 by the intermediary transfer belt 210, and are transferred together (secondary transfer) onto a sheet P of recording medium. More concretely, the image forming apparatus 200 is provided with a recording medium cassette 201, in which multiple sheets P of recording medium are storable. Each sheet P of recording medium in the cassette 201 is pulled out by a pickup roller 202 while being separated from the rest by a separation roller 203. Then, it is conveyed to a pair of registration rollers 204, which send the sheet P into the primary transfer station T2 with such timing that the sheet P enters the secondary transfer station T2 at the same time as the toner images on the intermediary transfer belt 210.

After the transfer (secondary transfer) of the four monochromatic toner images, different in color, onto the sheet P of recording medium, the sheet P is separated from the intermediary transfer belt 210 with the utilization of the curvature of the intermediary transfer belt 210. Then it is sent into a fixing device 100, which fixes the toner images to the surface of the sheet P by melting the toners (of which the toner images are formed) by applying heat and pressure to the sheet P and the toner images thereon. Thereafter, the sheet P is discharged from the image assembly of the image forming apparatus 200.

<Fixing Device>

Figure 2:
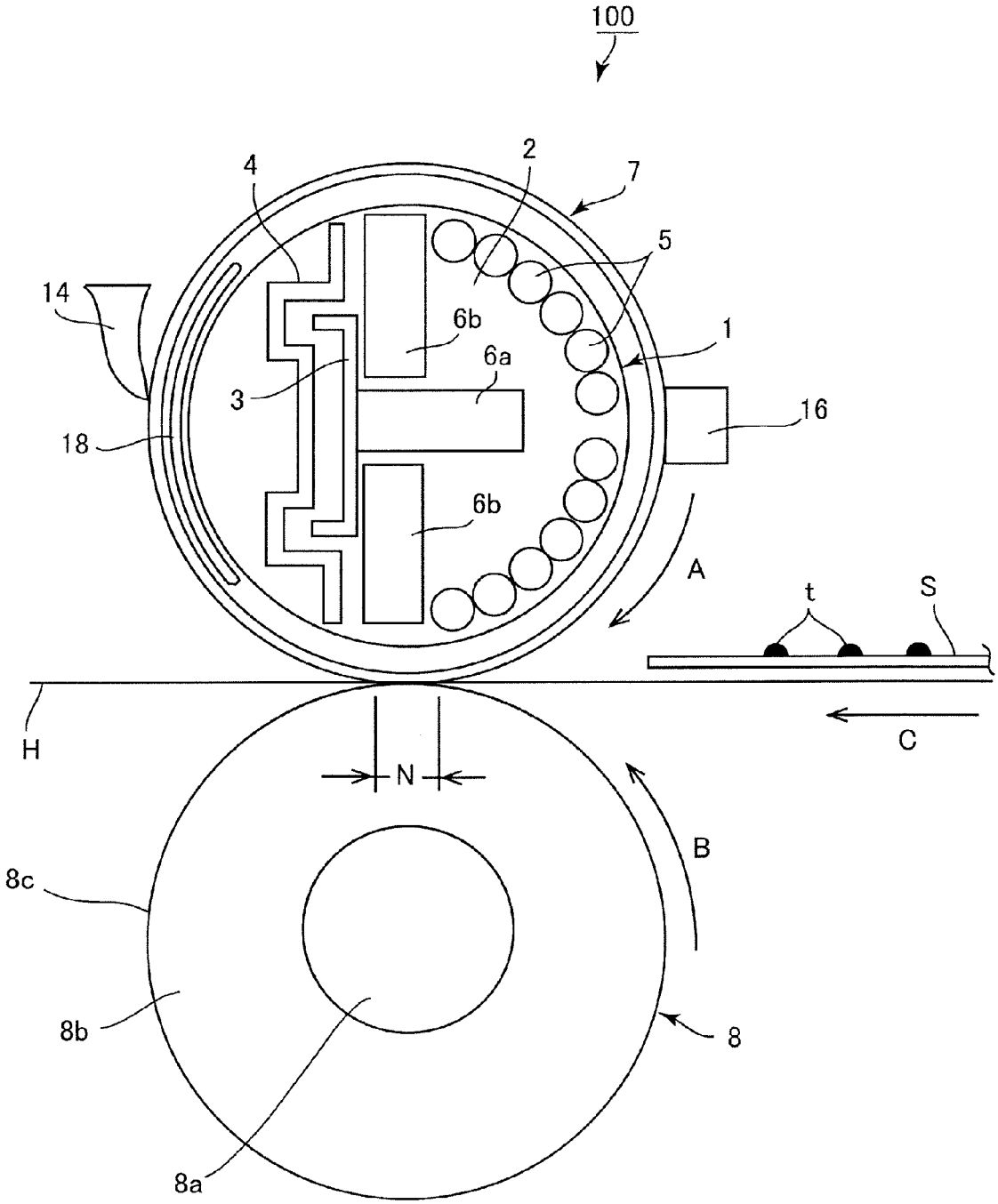
FIG. 2 is a schematic vertical sectional view of the fixing apparatus of the image forming apparatus in the first embodiment, at a plane perpendicular to the axial line of the heating roller of the apparatus, and shows the general structure of the fixing apparatus.
Figure 3:
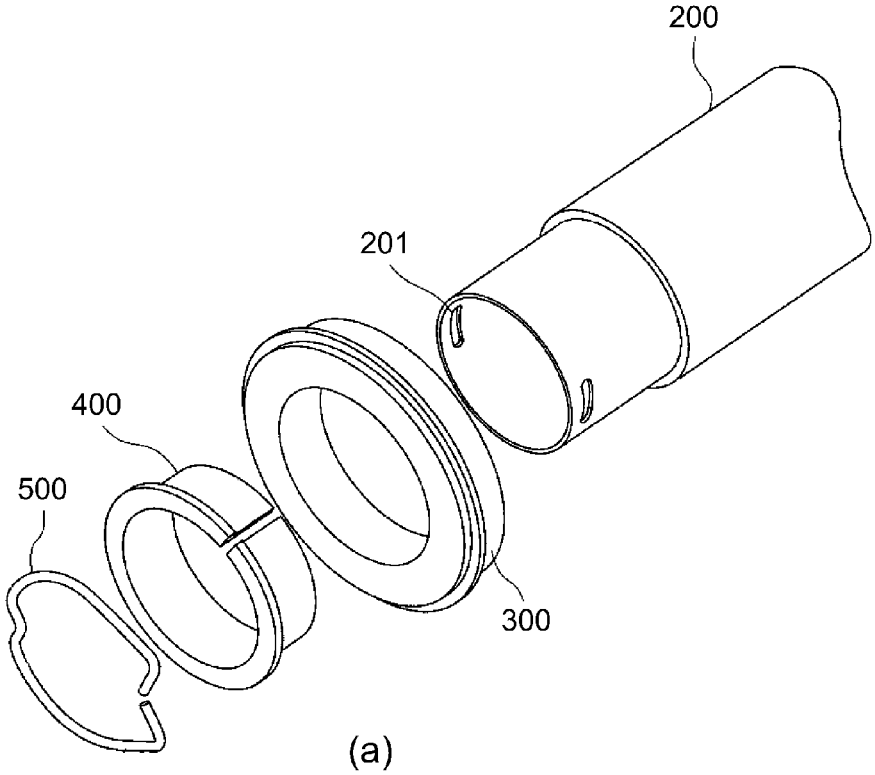
FIG. 3 is a perspective view of one of the lengthwise end portions of a conventional fixation roller, and shows the structure of the end portion.
Figure 3:
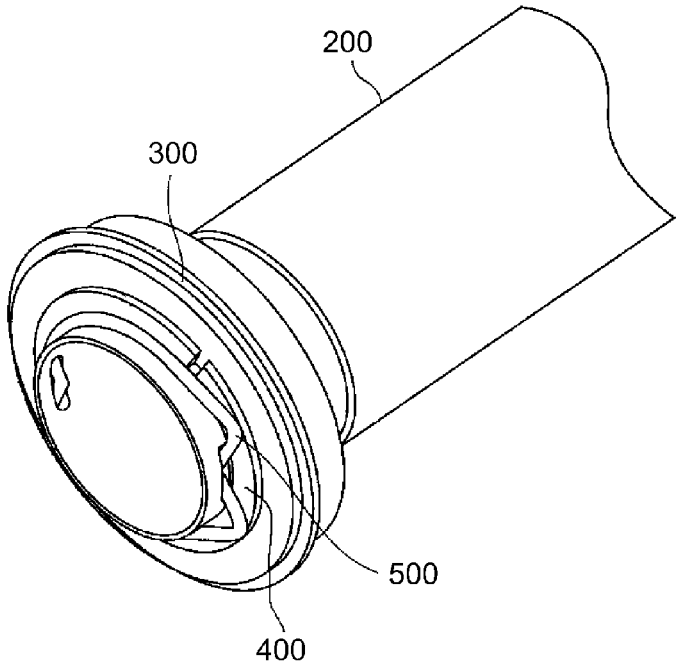

FIG. 2 is a schematic sectional view of the fixing device 100 (which is example of image heating apparatus), at a plane perpendicular to the axial line of the fixation roller of the fixing device 100, and shows the structure of the device. FIG. 3 is a perspective view of one of the lengthwise ends of the fixation roller 7 of the fixing device 100, and shows the structure of the lengthwise end.

Referring to FIG. 2, designated by a referential code 1 is a heating assembly, which is an example of heating means. This heating assembly 1 is a heating device of the electromagnetic induction type. It is in the hollow fixation roller 7, which is an example of an image heating member (image heating roller). The heating assembly 1 is replaceable. It is made up of an excitation coil 5, a first magnetic core 6*a*, a pair of second magnetic cores 6*b*, a holder 2, etc. The excitation coils 5, first magnetic cores 6*a* and 6*b* are attached to the holder 2. As the excitation coil 5 is provided with high frequency electric current, heat (Joule heat: heat resulting from eddy current loss) is generated in the fixation roller 7 (which contacts recording medium) by magnetic induction (induction heating).

The fixation roller 7 is a thin cylindrical tube which generates heat in response to magnetic induction. As for the material for the fixation roller 7, iron, nickel, cobalt, or the like metal can be used. The fixation roller 7 is reduced in thermal capacity by being made thin (in a range of roughly 0.3 mm-2.0 mm) in wall thickness. In this embodiment, the fixation roller 7 is 0.6 mm in wall thickness. Further, a highly magnetic metallic substance (which is high in permeability) is used as the material for the fixation roller 7, in order to make the magnetic flux, which is generated by the excitation coil 5 and guided by the cores 6*a* and 6*b*, permeate into the fixation roller 7 as much as possible. That is, the magnetic flux, which is related to heat generation, is increased in density, in order to efficiently generate eddy current in the fixation roller 7 to generate heat in the fixation roller 7. The surface layer of the fixation roller 7 is a parting layer (toner parting layer) which is roughly 10-50 μm in thickness and is made up of fluorinated resin such as PTFE and PFA. The fixation roller 7 may be provided with a rubber layer, as an elastic layer, which is placed between the parting layer and metallic core.

A fixation roller driving gear 20 is solidly fitted around one of the lengthwise ends of the fixation roller 7. As driving force is inputted into the driving gear 20, the fixation roller 7 rotates. The other lengthwise end of the fixation roller 7 is provided with three through holes 7*a*, the internal space of which is completely enclosed unlike a hole shaped like a letter U in cross section.

A pressure roller 8 is under the fixation roller 7 and is in contact with the fixation roller 7, being in parallel to the fixation roller 7. It is an elastic roller, and is rotated in the direction indicated by an arrow mark B by the rotation of the fixation roller 7 as the fixation roller 7 is rotated in the direction indicated by an arrow mark A. The pressure roller 8 is made up of a metallic core 8*a*, an elastic layer 8*b*, and a toner parting layer 8*c*. The metallic core 8*a* is formed of iron. The elastic layer 8*b* is formed of silicone rubber, and covers the peripheral surface of the metallic core 8*a*. The toner parting layer 8*c* covers the peripheral surface of the elastic layer 8*b*.

As the excitation coil 5 of the heating assembly 1 is supplied with electric power, the fixation roller 7 is heated by magnetic induction so that the temperature of the fixation roller 7 remains at a preset level (fixation temperature). While the temperature of the fixation roller 7 is kept at the fixation temperature, and the pressure roller 8 is rotated by the rotation of the fixation roller 7, a sheet S of recording medium, which is bearing an unfixed toner image t, which has just been transferred onto the sheet S in the secondary transfer station T2 of the image forming apparatus 200 shown in FIG. 1, is introduced into the heating nip N of the fixing device 100 through a recording medium conveyance passage H from the direction indicated by an arrow mark C. Then, the sheet S is conveyed through the heating nip N. While the sheet S is conveyed through the heating nip N, the unfixed toner image t on the surface of the sheet S is fixed to the sheet S by the heat from the fixation roller 7 and the nip pressure. More concretely, the unfixed toner image on the sheet S of recording medium is melted by the thermal energy applied to the sheet S and the toner image thereon, while being subjected to the pressure from the pressure roller 8. Thus, the melted toner of the toner image permeates the gaps among the fibers of the sheet S. As a result, the toner image becomes fixed to the sheet S as it cools down. As the sheet S is conveyed out of the fixation nip N, a separation claw 14 mechanically separates the sheet S from the fixation roller 7, preventing thereby the sheet S from wrapping around the fixation roller 7.

Figure 5:
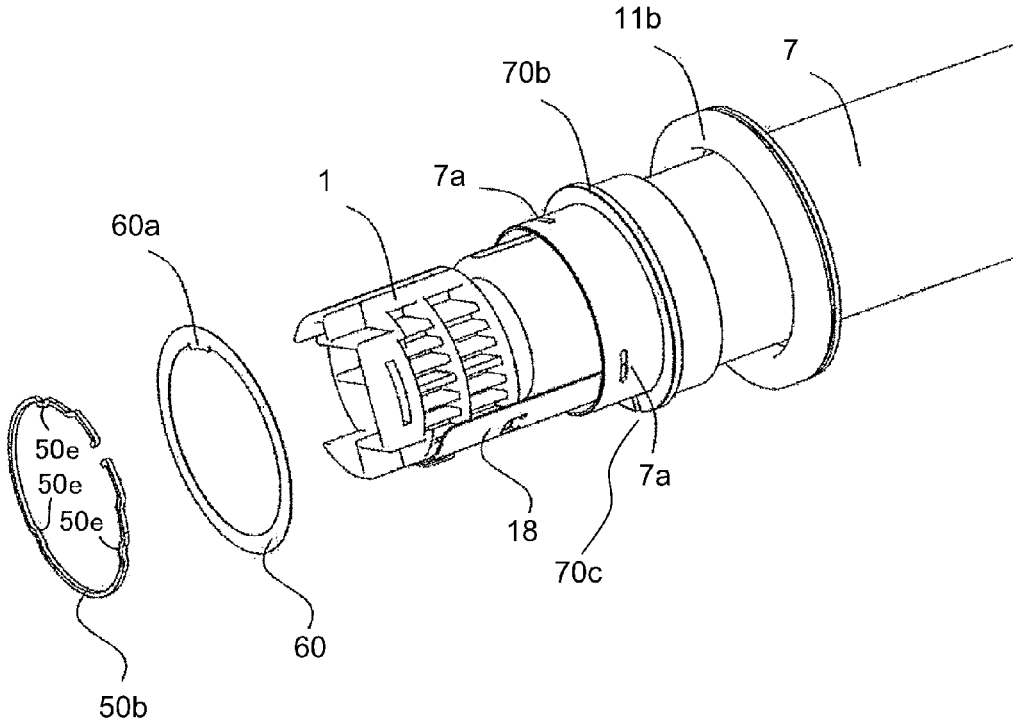
FIG. 5 is a perspective view of one of the lengthwise end portions of the fixation roller in the first embodiment of the present invention, and shows the structure of the end portion.

Referring to FIG. 5, the heating assembly 1 is placed in the hollow of the fixation roller 7. More concretely, the fixing device 100 is provided with a stationary stay 3, which extends from one end of the metallic core of the fixation roller 7 to the other through the hollow of the metallic core. The holder of the heating assembly 1 is supported by the stay 3. The aforementioned excitation coil 5 and magnetic cores 6*a* and 6*b* of the heating assembly 1 are stored inside the holder 2. The holder 2 is formed of heat resistant resin. It is in the form of a trough which is roughly semicircular in cross section. It is placed in the fixation roller 7 in such an attitude that its curved side faces where a sheet S of recording medium is introduced. Further, it is positioned in the fixation roller 7 so that a preset amount of gap is present between itself and the internal surface of the fixation roller 7. It is molded of nonmagnetic substance made by adding glass to resin of PPS group, which is heat resistant and mechanically strong. More concretely, nonmagnetic substances such as PPS, PEEK, polyimide, polyamide, polyamide-imide, ceramic, liquid polymer, fluorinated resin, and the like are suitable as the material for the holder 2.

The holder 2 holds multiple first magnetic cores 6*a* so that the magnetic cores 6*a* extend in parallel to the holder 2 through the center portion of the holder 2. It also holds the pair of second magnetic core 6*b* and 6*b*, which also are positioned so that they sandwich the magnetic core 6*a* and extend in parallel to the holder 2 (magnetic core 6*a*). The first magnetic core 6*a* and second magnetic core 6*b* are for increasing the magnetic circuit in efficiency and blocking magnetism. It is desired that a substance which is high in permeability and low in loss is used as the material for the first magnetic core 6*a* and second magnetic core 6*b*. For example, a magnetic substance such as ferrite and Permalloy which are used as the material for the core of a transformer may be used as the material for the first and second magnetic cores 6*a* and 6*b*, respectively.

The excitation coil 5 is positioned so that its center coincides with the magnetic core 6*a*. In order to ensure that the excitation coil 5 generates alternating magnetic flux strong enough for heating, the excitation coil 5 needs to be low in resistance and high in inductance. The material for the excitation coil 5 in the embodiments of the present invention is a Litz wire which is made up of 140 wires which are 0.17 mm in diameter and are 4 mm in external diameter. In consideration of the temperature increase of the excitation coil 5, a heat resistance substance was used as the material for insulating the Litz wire. By placing the first magnetic core 6*a* and second magnetic cores 6*b* and 6*b* close to the internal surface of the fixation roller 7, it is possible to increase the amount by which the magnetic flux generated by the excitation coil 5 enters the heat generating layer of the fixation roller 7, and therefore, it is possible to increase the fixation roller 7 in heat generation efficiency.

A holder cap 4 is roughly semicircular in cross section. It is attached to the holder 2 which internally holds the first magnetic core 6*a* and excitation coil 5. The material for the holder cap 4 is the same as that for the holder 2. The first magnetic core 6*a* and excitation coil 5 are held in the fixation roller 7 by being held sandwiched between the holder 2 and holder caps 4.

The holder 2 is nonrotationally supported by its lengthwise ends, by a pair of holder supporting plates 30*a* and 30*b*, which are on the outward side of the side plates 12*a* and 12*b* of the fixing device 100, respectively. The fixation roller 7 is hollow, and is rotatably held between the left and right side plates 12*a* and 12*b* of the fixing device 100, with the presence of a pair of thermal insulation bushings 70*a* and 70*b* and a pair of bearings 11*a* and 11*b* between the left and right side plates 12*a* and 12*b*, respectively. The fixation roller 7 is rotated at a preset peripheral velocity by the rotational force transmitted from a driving mechanism M to the fixation roller gear 10 solidly attached to one of the lengthwise ends of the fixation roller 7.

The metallic core 8*a* of the pressure roller 8 is rotatably supported by a pair of bearings 15*a* and 15*b* with which a pair of pressure roller supporting frames 12*c* and 12*d* are provided, respectively. The pressure roller supporting frame 12*c* and 12*d* are kept pressed upon the bottom side of the peripheral surface of the fixation roller 7 by a preset amount of pressure generated by an unshown pressure application mechanism (compression springs), forming thereby a heating nip N, which has a preset dimension in terms of the direction parallel to the recording medium conveyance direction.

The fixing device 100 is provided with a temperature control thermistor 16, which is positioned so that it faces roughly the middle of the fixation roller 7 in terms of the lengthwise direction of the fixation roller 7. A control circuit 17 controls the fixation roller 7 in temperature in response to the temperature signals outputted by the temperature control thermistor 16 so that the temperature of the fixation roller 7 remains at a preset level (target temperature). More concretely, in order to maintain the surface temperature of the fixation roller 7 at the preset level (target temperature), the control circuit 17 controls the amount by which electric power is supplied to the excitation coil 5 by an electric power control device 13 (excitation circuit), according to a temperature control program.

A sheet S of recording medium is conveyed through the fixing device 100 so that the center of the sheet S coincides with the center of the recording medium passage of the fixing device 100 in terms of the direction perpendicular to the recording medium conveyance direction. That is, it is the centerline CL of the recording medium conveyance passage of the fixing device 100 that the center of a sheet S of recording medium is aligned when the sheet S is conveyed through the fixing device 100. In order for a sheet S of recording medium to be properly conveyable through the fixing device 100, the sheet S has to be no more than 297 mm (length of sheet of size A4) in the dimension W1 in terms of the direction parallel to the fixation roller 7, and no less than 210 mm (width of sheet of size A4) mm in dimension W2 in terms of the direction parallel to the fixation roller 7. The normal attitude in which a sheet S of recording medium is conveyed through the fixing device 100 is such that the long edge of a sheet S of recording medium is perpendicular to the recording medium conveyance direction. Hereafter, therefore, W1 stands for the width of a sheet S of recording medium which is being conveyed in the normal attitude.

The measurement of the first magnetic core 6*a*, which is positioned in parallel to the lengthwise direction of the holder 2, is roughly the same as that of the dimension W1 of the long edge of a sheet S of size A4. That is, when a sheet S of recording medium which is A4 in size is conveyed through the fixing device 100 in such an attitude that the longer edge of the sheet S is perpendicular to the recording medium conveyance direction, the first magnetic core 6*a* roughly coincides in position and dimension with the sheet S. The second magnetic cores 6*b* and 6*b* are the same in length as the dimension W1 of the long edge of a sheet S of recording medium of size A4. Thus, when a sheet S of recording medium which is A4 in size is conveyed through the fixing device 100 in such an attitude that the longer edge of the sheet S is perpendicular to the recording medium conveyance direction, the second magnetic cores 6*b* and 6*b* roughly coincide in position and dimension with the sheet S.

The two areas of the fixation nip N designated by a referential code W3 are out-of-sheet-path areas of the fixation nip N, which occur when a sheet S of recording medium of size A4 is conveyed in the normal attitude through the fixing device 100. That is, each of these areas is the area between one of the edges of the recording medium passage, and the path of a sheet S of recording medium of size A4 which is being conveyed in the normal attitude. The fixing device 100 is provided with a pair of shutter thermistors 22 and 23. The shutter thermistor 22 is positioned so that it faces the out-of-sheet-path area W3. The shutter thermistor 23 is positioned so that it faces the outward side of the out-of-sheet-path area W3.

The control circuit 17 sets target temperature level for the temperature control of the fixation roller 7, according to the temperatures detected by the shutter thermistors 22 and 23. If the temperature values detected by the shutter thermistors 22 and 23 are greater than an acceptable range, the control circuit 17 blocks the magnetic flux by moving a magnetic flux blocking member 18, which is in the gap between the heating assembly 1 and fixation roller 7.

<Magnetic Flux Blocking Member>

Figure 4:
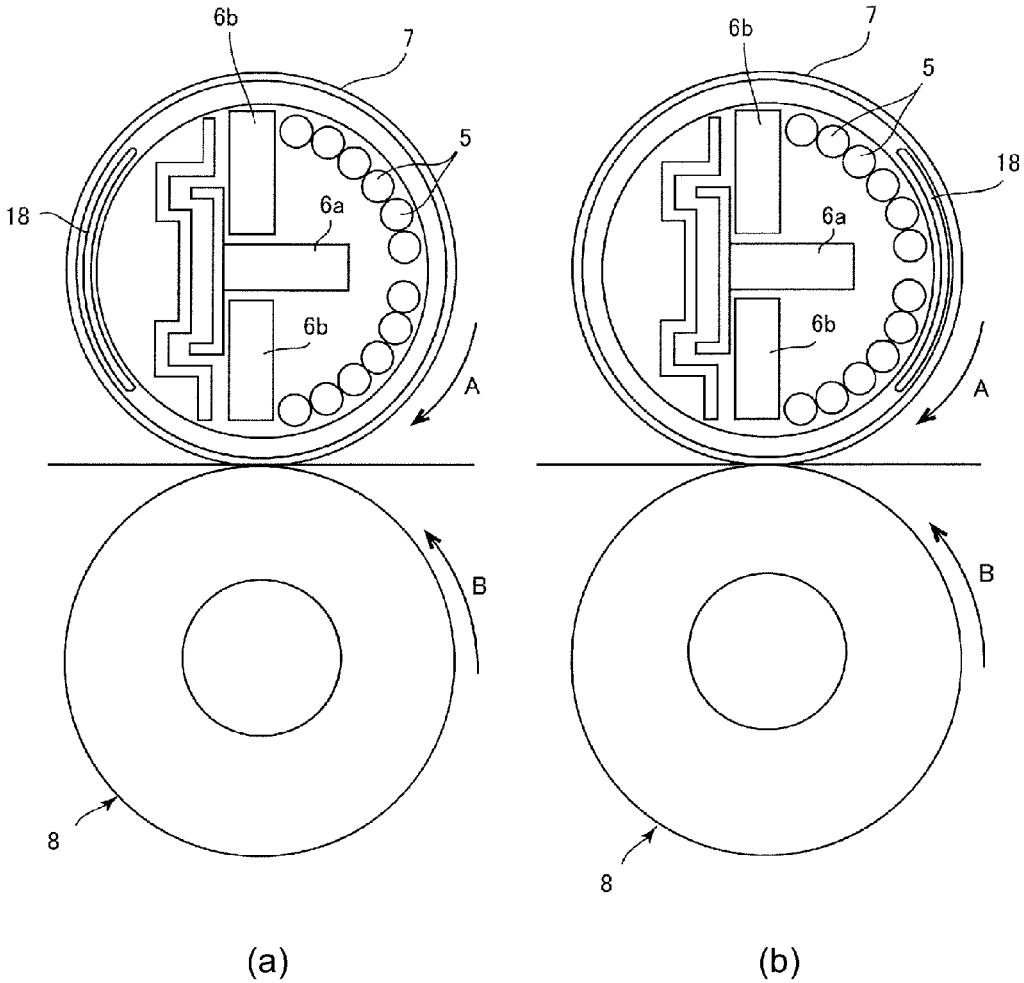
FIG. 4 is a schematic sectional view of the combination of the heating roller and pressure roller of the fixing apparatus, at a plane perpendicular to the heating roller, and shows the movement of the magnetism blocking member 18.

FIG. 4 is a drawing for describing the movement of a magnetic flux blocking member 18 (which hereafter will be referred to simply as blocking member 18). The blocking member 18 is a shutter for partially blocking the magnetic flux which is generated by the excitation coil 5 and acts on the fixation roller 7. The partial blocking of the alternating magnetic flux by the blocking portion 18*a* of the blocking member 18 can prevent the out-of-sheet-path portions of the fixation roller 7, that is, the lengthwise end portions of the fixation roller 7, from becoming excessively hot.

The blocking member 18 is provided with a driving gear 20, which is attached to one of the lengthwise ends of the blocking member 18 and in connection to a motor. As the driving gear 20 is rotated by the motor, the blocking member 18 moves in the circumferential direction of the fixation roller 7. The gear 20 is provided with three slits. The two of the slits correspond in position to the magnetic flux blocking position of the blocking member 18, and one of the slits corresponds in position to the position of the blocking member 18, in which the blocking member 18 does not block the magnetic flux. The position of the blocking member 18 is detected by a gear position sensor.

The blocking member 18 is desired not to increase in temperature. Thus, the suitable materials for the blocking member 18 are copper, aluminum, silver or silver alloy, and the like, which are electrically conductive (for allowing induction current to flow), nonmagnetic, and small in specific resistivity, and also, ferrite and the like, which are large in electrical resistance. It is possible to use magnetic substances such as iron and nickel as the material for the blocking member 18, provided that the blocking member 18 is provided with multiple circular holes, slits, or the like for preventing the blocking member 18 from being excessively heated by the heat generated by the eddy current. The blocking member 18 is made up of a pair of blocking portions and a connective portion. The pair of semicircular portions are semicircular in cross section, and are connected to each other by the connective portion in such a manner that they correspond in position to the out-of-sheet-path areas of the fixation roller 7.

The control circuit 17 rotates the motor, based on the signals outputted by a gear position sensor to indicate the position of the blocking member 18, and the signals outputted by a recording medium size sensor (unshown) to indicate the size of a sheet S of recording medium which is being conveyed to the heating nip N. The control circuit 17 sets width and position for the blocking portion of the blocking member 18, based on the size of the sheet S of recording medium which is assumed to require the blocking of the magnetic flux. Then, control circuit 17 rotates the blocking member 18 about the axial line of the fixation roller 7, along the inward surface of the fixation roller 7, from the home position of the blocking member 18 to the blocking position, or from the blocking position to the home position.

Referring to FIG. 4(*a*), when an image is formed on a widest sheet of recording medium, in terms of the direction perpendicular to the recording medium conveyance direction, usable by the image forming apparatus 200, the blocking member 18 is held in its home position, which is in the opposite side of the fixation roller 7 from the excitation coil 5 of the heating assembly 1. The home position for the blocking member 18 corresponds in position to the portion of the fixation roller 7, to which the magnetic flux from the heating assembly 1 hardly reach. When the blocking member 18 is in the home position, the alternating magnetic flux, which is guided to the fixation roller 7 by the first magnetic core 6*a* and second magnetic cores 6*b*, is not blocked at all across the entire range in terms of the lengthwise direction of the fixation roller 7, and therefore, heats (induction heating) the entire range of the fixation roller 7 in terms of the lengthwise direction of the fixation roller 7.

Next, referring to FIG. 4(*b*), when the sheet S of recording medium which is being used for image formation is conveyed in such an attitude that its edges perpendicular to the recording medium conveyance direction is the smallest width which the fixation roller 7 can accommodate, the blocking member 18 is held in its blocking position, which is in the same side of the fixation roller 7 as the excitation coil 5 of the heating assembly 1. When the blocking member 18 is in the blocking position, the magnetic flux generated by the heating assembly 1 to heat the fixation roller 7 is partially blocked by the blocking portions of the blocking member 18 so that the magnetic flux does not reach the portions of the fixation roller 7, which corresponds in position to the out-of-sheet-path areas of the recording medium passage of the fixing device 100. The blocking member 18 is shaped so that it blocks the portions of the fixation roller 7, which correspond in position to the out-of-sheet-path areas (when sheet of recording medium narrower than widest sheet of recording medium conveyable through fixing device 100 is conveyed), from the magnetic flux. Therefore, it is possible to prevent the problem that when a substantial number of narrow sheets S of recording medium are continuously conveyed, the lengthwise end portions of the fixation roller 7, which correspond in position to the out-of-sheet-path areas of the recording medium passage, excessively increases in temperature. When the blocking member 18 is in the blocking position, the parts of the alternating magnetic flux (which correspond in position to lengthwise end portions of fixation roller 7) are blocked by the blocking portions of the blocking member 18. Therefore, the portions of the fixation roller 7, which correspond in position to the out-of-sheet-path areas of the recording medium passage, are prevented from significantly increasing in temperature.

Incidentally, the mechanism for preventing the portions of the fixation roller 7, which correspond in position to the out-of-sheet-path areas of the recording medium passage, from excessively increasing in temperature does not need to be such that employs the blocking member 18. For example, the heating assembly heating assembly 1 may be structured so that the magnetic core 6*a* can be moved relative to the excitation coil 5 in order to adjust the magnetic flux in density distribution in terms of the lengthwise direction of the fixation roller 7, by changing the magnetic flux path from the excitation coil 5 to the fixation roller 7.

<Embodiment 1>

Figure 6:
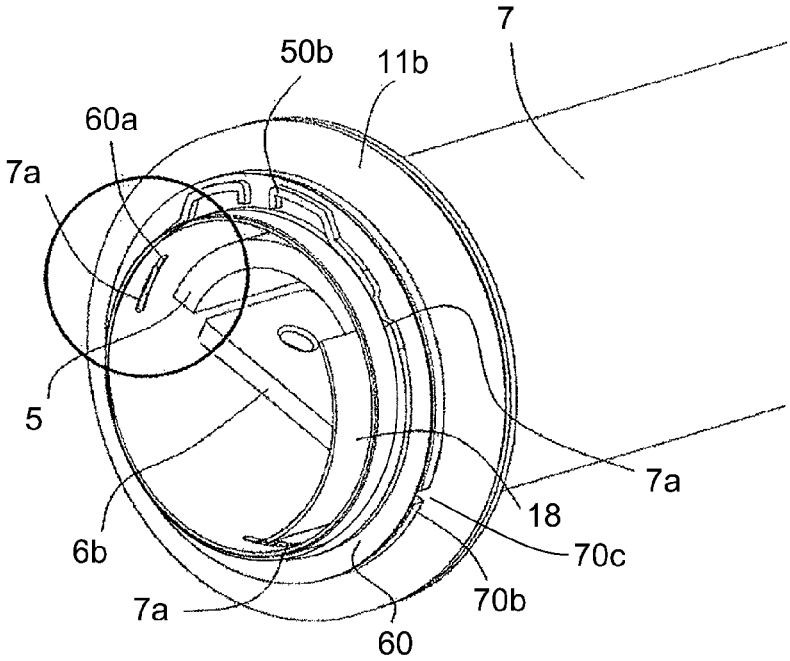
FIG. 6 is a drawing for describing one of the through holes, with which each of the lengthwise end portions of the fixation roller is provided.
Figure 6:
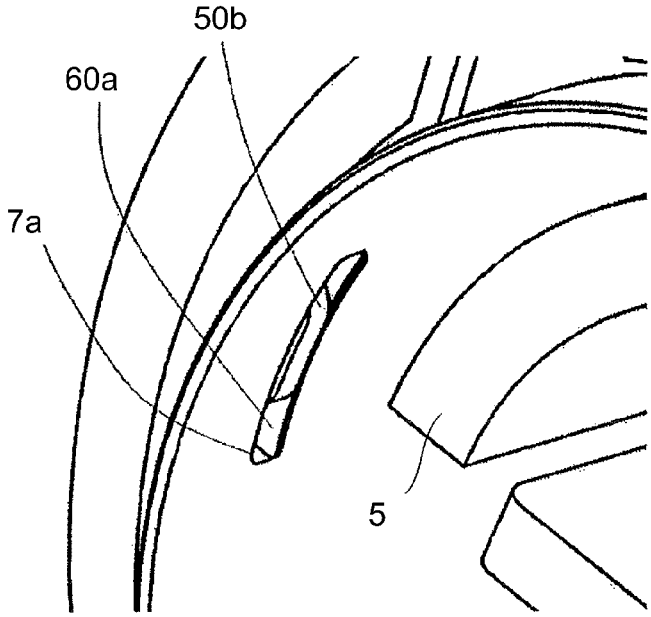
Figure 7:
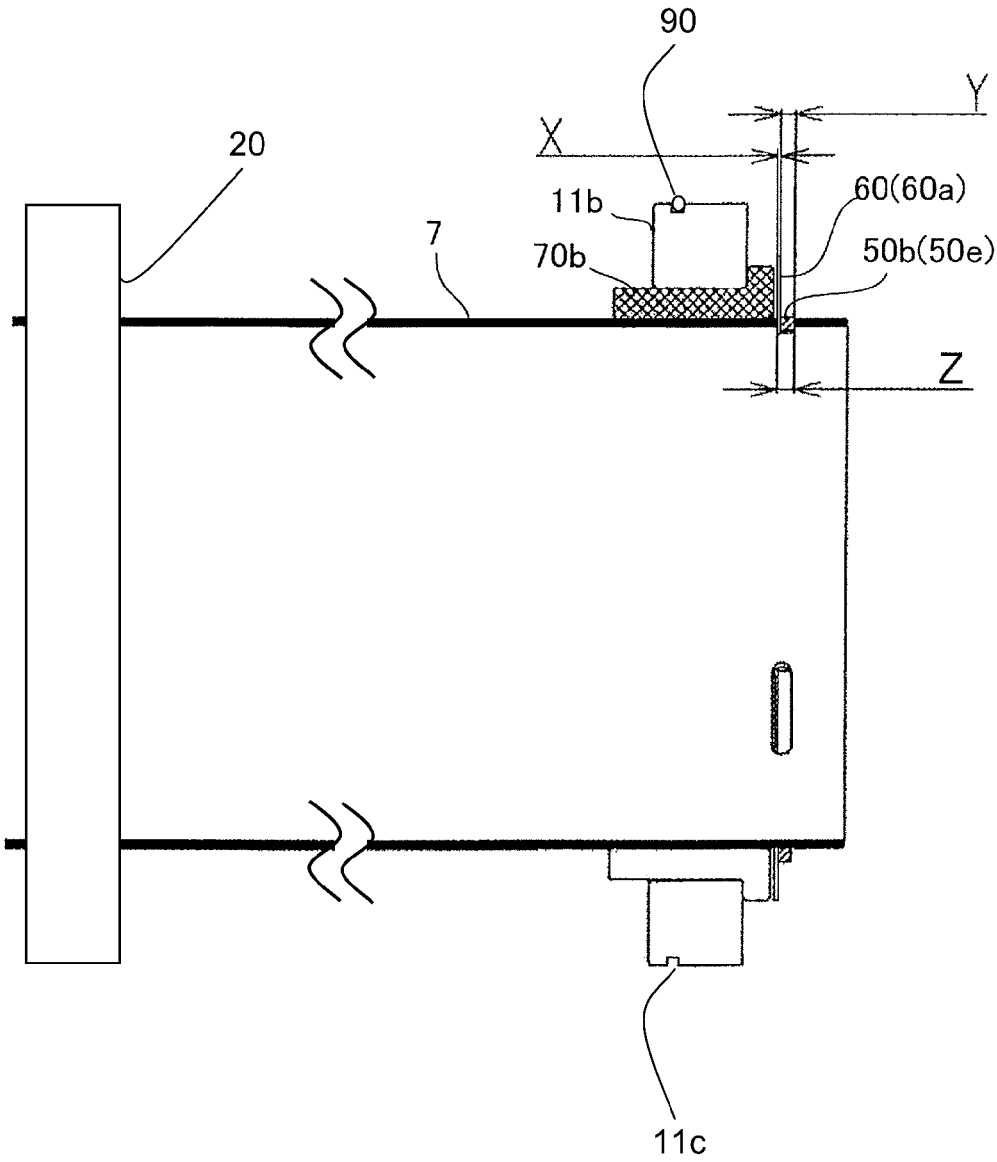
FIG. 7 is a schematic side view of one of the lengthwise end portions of the fixation roller, and shows the dimension of the through hole of the fixation roller in terms of the lengthwise direction of the fixation roller.
Figure 8:
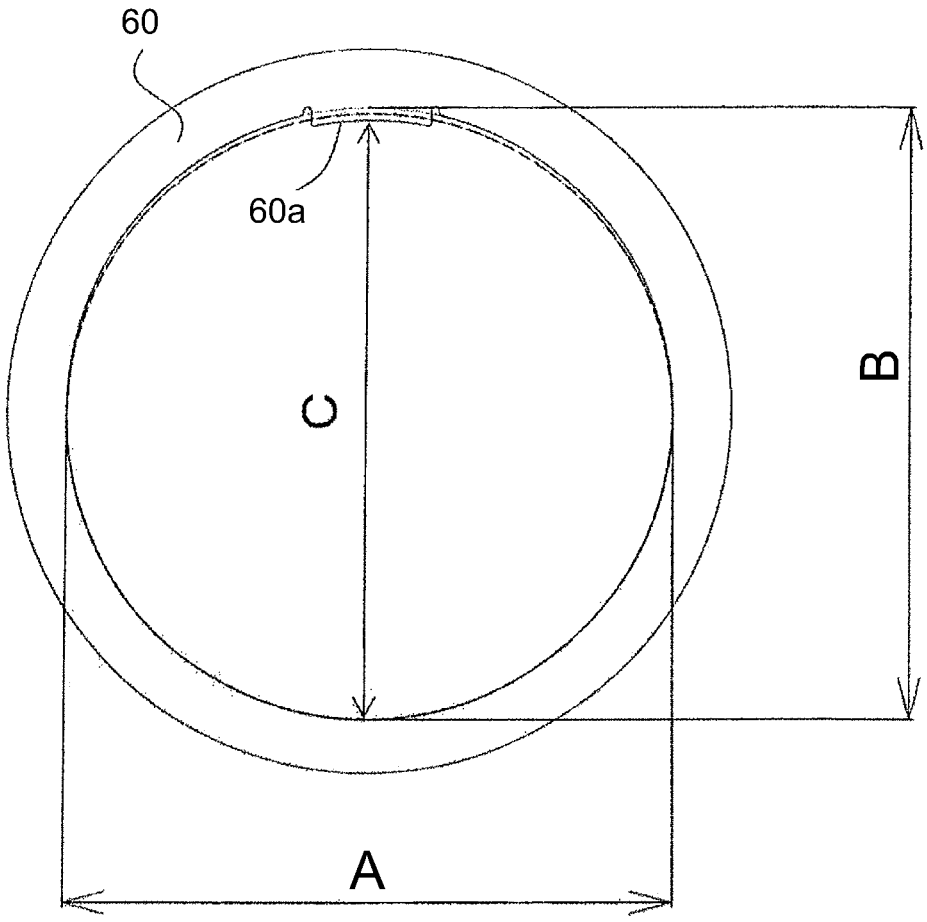
FIG. 8 is a plan view of the spacer in the first embodiment of the present invention.
Figure 9:
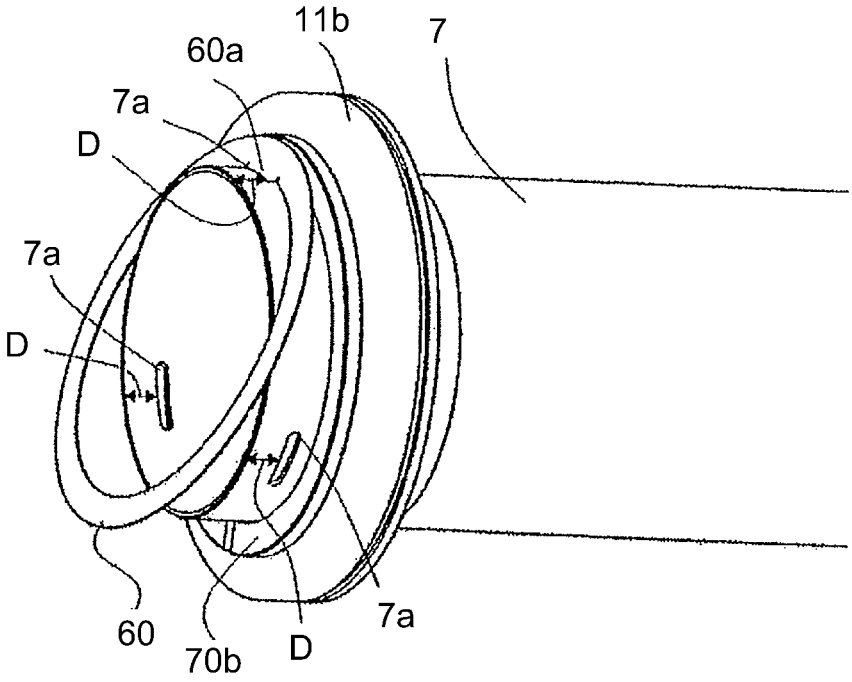
FIG. 9 is a schematic perspective view of one of the lengthwise end portions of the fixation roller in the first embodiment, and shows the order in which the spacer is fitted around the fixation roller.
Figure 9:
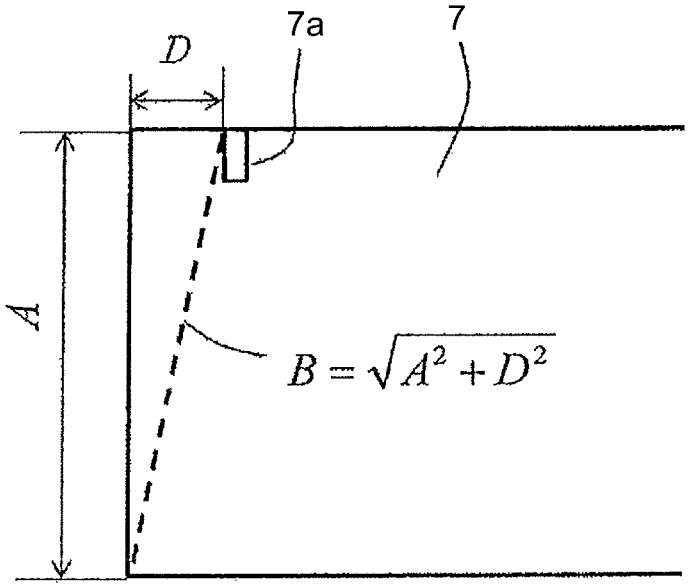

FIG. 5 is an exploded perspective view of one of the lengthwise end portions of the combination of the fixation roller and heating assembly 1 in the first embodiment of the present invention, and describes how the combination is assembled. FIG. 6 is a perspective view of one of the lengthwise end portions of the combination of the fixation roller and heating assembly 1 in the first embodiment of the present invention, and describes the positioning of the through holes of the fixation roller 7 in terms of the circumferential direction of the fixation roller 7. FIG. 7 is a side view of the opposite lengthwise end portions of the combination of the fixation roller and heating assembly 1 from the lengthwise end portion of the fixation roller 7, to which the driving gear 20 is attached, in the first embodiment of the present invention, and describes the dimension of the through holes in terms of the lengthwise direction of the fixation roller 7. FIG. 8 is a plan view of the spacer 6. FIG. 9 is a drawing of the opposite lengthwise end of the combination of the fixation roller 7 and the auxiliary components to the fixation roller 7, and describes the order in which the spacer 6 is fitted. FIGS. 5, 6, 7, 8 and 9 describe the structure of the opposite end portion of the combination of the fixation roller 7 and the components auxiliary to the fixation roller 7, from the lengthwise end portion of the combination, to which the driving gear 20 is attached.

Referring to FIGS. 5 and 6, the bearing 11 (which is an example of a bearing member), and a thermal insulation bushing 70*b* (which is an example of a thermally insulating member and is roughly cylindrical), are fitted around the lengthwise end portion of the fixation roller 7 from the direction parallel to the axial line of the fixation roller 7, and rotatably support the fixation roller 7.

The thermal insulation bushing 70*b* is fitted around the fixation roller 7 on the outward side of the fixation roller 7 in terms of the lengthwise direction of the fixation roller 7 to minimize the amount by which heat leaks from fixation roller 7 through the bearing lib. The bearing lib rotatably supports the thermal insulation bushing 70*b*. Referring also to FIGS. 5 and 6, the thermal insulation bushing 70*b* is provided with a slit 70*c* (and so does thermal insulation bushing shown in FIG. 3), in anticipation of the thermal expansion of the thermal insulation bushing 70*b* which occurs while the fixing device 100 is in operation.

The aforementioned three through holes 7*a*, with which each of the lengthwise end portions of the fixation roller 7 is provided, are used to keep a C-shaped retaining ring 50*b* and a spacer 60 attached to the fixation roller 7. In this embodiment, however, there is the heating assembly 1 in the hollow of the fixation roller 7. Therefore, it is possible that as the C-shaped retaining ring 50*b* is attached to the fixation roller 7 by being fitted into the through holes 7*a*, the C-shaped retaining ring 50*b* will interfere with the heating assembly 1. That is, this structural arrangement is effective, in particular, in a case where the inwardly protruding portion of the C-shaped retaining ring 50*b*, which will be described later, cannot be inserted deep enough into the fixation roller 7 through the through hole 7*a* to keep the C-shaped retaining ring 50*b* firmly attached to the fixation roller 7.

Referring again to FIG. 5, each of the lengthwise end portions of the fixation roller 7 is provided with three through holes 7*a*, which are equal in dimension in terms of the lengthwise direction as well as in terms of the circumferential direction. In terms of the lengthwise direction of the fixation roller 7, the three through holes 7*a* are located a preset distance from the lengthwise end of the fixation roller 7. In terms of the circumferential direction of the 7*a*, the three through holes 7*a* are separated from each other by the same angle (120°). The spacer 60 is provided with a key portion 60*a*, which is a portion which projects toward the center of the spacer 60 from the inward edge of the spacer 60. Thus, the spacer 60 is attachable to the fixation roller 7 by fitting its key portion 60*a* into one of the three through holes 7*a* of the fixation roller 7.

The C-shaped retaining ring 50*b* is an example of virtually circular regulating member (retaining ring). It is C-shaped so that it can fitted around the peripheral surface of the fixation roller 7. It has multiple (three in this embodiment) inwardly protruding portion, which are to be fitted into the three through holes 7*a*, one for one, to keep the C-shaped retaining ring 70*b* in the preset position, in terms of the direction parallel to the axial line of the fixation roller 7. The C-shaped retaining ring 50*b* is formed by bending a piece of springy wire, which is made of stainless steel and square in cross section, with the use of a wire forming process, in such a manner that the C-shaped retaining ring 50*b* will be provided with three portions 50*e* which project inward of the C-shaped retaining ring 50*b*. The C-shaped retaining ring 50*b* is firmly attached to the fixation roller 7 by fitting its three inwardly protruding portions into the three through holes 7*a* of the fixation roller 7, one for one.

The spacer 60, which is an example of a ring-shaped spacer, is formed of a piece of flat plate, by punching. It has one key portion 60*a* (engaging portion), which is to be fitted into one of the three through holes 7*a* of the fixation roller 7. The key portion 60*a* of the spacer 60 is fitted, along one of the inwardly protruding portions 50*e* of the C-shaped retaining ring 50*b*, into one of the three through holes 7*a* of the fixation roller 7 to regulate the spacer 60 in position in terms of the lengthwise direction of the fixation roller 7. The spacer 60 is formed of a piece of thin metallic plate, by punching. It has the key portion 60*a*, which projects from the inward edge of the ring-shaped main portion of the spacer 60. As the key portion 60*a* of the spacer 60 is fitted into one of the three through holes 7*a* of the fixation roller 7, the spacer 60 is prevented from rotating around the fixation roller 7.

The fixation roller 7 is formed cylindrical and hollow. It is open at both of its lengthwise ends. It internally holds the heating assembly 1. Each of the lengthwise end portions of the fixation roller 7 is fitted with the thermal insulation bushing 70*b*, which is an example of a thermally insulating member and is fitted around the fixation roller 7. The aforementioned thermal insulation bushing 70*b* is fitted around the fixation roller 7, on the outward side of the bearings lib, which is supported by the metallic supporting plate of the main assembly of the fixing device 100. The thermal insulation bushing 70*b* is simply fitted around the fixation roller 7, and therefore, is allowed to rotate relative to the fixation roller 7.

The fixing device 100 is structured so that as the bearing 11*b* is fitted in the U-shaped groove of the metallic supporting plate of the main assembly of the fixing device 100, it is precisely positioned relative to the metallic supporting plate. Referring to FIG. 7, the peripheral surface portion of the bearing 11*b* is provided with a groove 11*c*. Thus, the bearing 11*b* is firmly attached to the metallic supporting plate by fitting a bearing anchoring member (which is in the form of a piece of wire) in the top portion of the groove 11*c*, and anchoring the lengthwise ends of the bearing anchoring member 90 to the metallic supporting plate. As the bearing 11*b* is firmly attached to the metallic supporting plate, it is precisely positioned in terms of the direction parallel to the axial line of the fixation roller 7.

The bearing 11*b* and thermal insulation bushing 70*b* are fitted around the fixation roller 7 in the listed order. Then, the spacer 60 is fitted around the fixation roller 7. Thereafter, the C-shaped retaining ring 50*b* is fitted around the fixation roller 7 while being kept elastically expanded slightly. Thus, the thermal insulation bushing 70*b* is prevented by spacer 60 from moving in the direction parallel to the lengthwise direction of the fixation roller 7 (direction parallel to axial line of fixation roller 7). That is, thermal insulation bushing 70*b* is prevented from moving leftward in FIG. 6 (it is prevented from disengaged from fixation roller 7).

Next, referring to FIG. 6(*a*), each of the lengthwise end portions of the fixation roller 7 is provided with the three through holes 7*a*, which are evenly spaced in terms of the circumferential direction of the fixation roller 7. More specifically, the three through holes 7*a* are separated by 120° from each other. Next, referring to FIG. 5, as for the positional relationship among the three inwardly protruding portions 50*e* of the C-shaped retaining ring 50*b* in terms of the circumferential direction of the C-shaped retaining ring 50*b*, the three protruding portions 50*e* are separated by 120°. Therefore, the positional relationship between the C-shaped retaining ring 50 and fixation roller 7 in terms of their circumferential direction does not need to be specific. The C-shaped retaining ring 50*b* may be attached to the fixation roller 7 as long as they are positioned relative to each other in such a manner that the three inwardly protruding portions of the C-shaped retaining ring 50*b*, which are separated from each other by 120° in terms of the circumferential direction of the ring 50*b*, fit into the three through holes 7*a* of the fixation roller 7, which are separated from each other by 120° in terms of the circumferential direction of the fixation roller 7, one for one.

As described above, after the key portion 60*a* of the spacer 60 is fitted into one of the three through holes 7*a*, one of the inwardly protruding portions 50*e* of the C-shaped retaining ring 50 is fitted into the same through hole 7*a* as the one into which the key portion 60*a* of the spacer 60 is fitted. In other words, it is unnecessary for the fixation roller 7 to be provided with a through hole dedicated to the key portion 60*a*. That is, not only can this embodiment eliminate the issue that providing the fixation roller 7 with an additional through hole dedicated to the key portion 60*a* of the spacer 60 reduces the fixation roller 7 in rigidity, but also, it can make it unlikely for the inwardly protruding portions 50*e* from coming out of the through holes 7*a* of the fixation roller 7.

Referring to FIG. 7, the width of the through hole 7*a* equals the sum of the thickness of the spacer 60 and the thickness of the C-shaped retaining ring 50*b*. The design of the fixing device 100 is such that when the thickness of the key portion 60*a* of the spacer 60, thickness of the C-shaped retaining ring 50*b*, and the width of the through hole 7*a* of the fixation roller 7 are X, Y and Z, respectively, there is the following relationship among X, Y and Z:

Z=X+Y.

In the first embodiment, X=0.2 mm, Y=1.0 mm and Z=1.2 mm. Since the sum of the thickness X of the key portion 60*a* of the spacer 60 and the thickness Y of the C-shaped retaining ring 51*b* is practically equal to the width Z of the through hole 70*a* of the fixation roller 7, the inwardly protruding portion of the C-shaped retaining ring 51*b* is held in the through hole 7*a* without a play in terms of the widthwise direction of the through hole 7*a* (there is a small amount of play necessary for allowing the combination of the key portion 60*a* and the inwardly protruding portion of the C-shaped retaining ring 50*b* to be fitted into through hole 7*a*). Thus, the C-shaped retaining ring 51*b* and spacer 60 held to the fixation roller 7, while remaining in contact with each other with the presence of virtually no gap between them. Therefore, the C-shaped retaining ring 51*b* is unlikely to separate from the fixation roller 7.

The external diameter of the spacer 60 is greater than that of the thermal insulation bushing 70*b*. Therefore, it is possible to prevent the thermal insulation bushing 70*b* and C-shaped retaining ring 51*b* from rubbing against each other. In the first embodiment, the external diameter of the spacer 60 is 48.5 mm, and that of the thermal insulation bushing 70*b* is 48.0 mm.

Referring to FIG. 8, the spacer 60 is shaped so that its inward circumferential edge (surface), which is to face the peripheral surface of the fixation roller 7 is oval. The key portion 60*b* (engaging portion) is at one of the two points of the inward circumferential edge (surface), which corresponds to the major axis of the oval edge (surface). The length of the major axis of the inward circumference of the spacer 60 is such that when the spacer 60 is rotationally moved about its key portion 60*b* after the fitting of the key portion 60*b* into one of the three through holes 7*a*, the opposite portion of the spacer 60 from the key portion 60*b* clears the lengthwise end of the fixation roller 7.

The spacer 60 is formed of a springy material, more concretely, a thin plate of stainless steel which is 0.2 mm in thickness. Its external contour is circular, whereas its internal contour is oval. It has the key portion 60*a*, which protrudes from the inward edge of the spacer 60 toward the center of the spacer 60. Assuming that the lengths of the minor and major axes of the internal edge (oval) are A and B, respectively, the value of A equals the external diameter of the fixation roller 7. The value for B is set so that the following mathematical formula is satisfied:

$$B=\sqrt{A^2+D^2}$$

Further, the distance C from the end of the key portion 60*a* to the opposite side of the inward edge of the spacer 60 from the key portion 60*a* satisfies the following mathematical formula (inequality), in which a letter C stands for the distance from the end of the key portion 60*a* to the opposite side of the inward edge of the spacer 60 from the key portion 60*a*:

$$A>C+(B-A)$$

Referring to FIG. 9(*a*), the method for attaching the spacer 60 to the fixation roller 7 by fitting the spacer 60 around the fixation roller 7 is as follows. First, the key portion 60*a* of the spacer 60 is to be fitted into one of the three through holes 7*a* of the fixation roller 7 by tilting the spacer 60, and to rotationally move the spacer 60 about the key portion 60*a* so that the spacer 60 becomes perpendicular to the fixation roller 7.

Next, referring to FIG. 9(*b*), the distance D between the lengthwise end of the fixation roller 7 and each of the three through holes 7*a* is such that when the spacer 60 is rotationally moved about its key portion 60*a* to be fitted around the fixation roller 7 after the insertion of its key portion 60*a* into one of the three through holes 7*a* of the fixation roller 7, the distance between the end of the key portion 60*a* and the opposite side of the inward edge of the spacer 60 from the end of the key portion 60*a* does not become smaller than the external diameter A of the fixation roller 7. Therefore, it does not occur that when the spacer 60 is made perpendicular to the peripheral surface of the fixation roller 7 to be placed in contact with the surface of the thermal insulation bushing 70*b*, the lengthwise end of the fixation roller 7 does not interfere with the spacer 60.

Further, designing the spacer 60 so that its major axis B satisfies Formula (1) can makes it possible to ensure that the key portion 60*a* and fixation roller 7 remains engaged with each other, while minimizing the play (B−A) which occurs as the spacer 60 is fitted around the fixation roller 7. In the first embodiment, A=40.0 mm and D=4.0 mm. Therefore, B=40.2 mm. Incidentally, the minor axis A of the oval inward edge of the spacer 60 is 40.0 mm, which is the same as the external diameter of the fixation roller 7.

Further, designing the spacer 60 so that the distance C between the end of the key portion 60*b* of the spacer 60 and the opposite portion of the inward edge of the spacer 60 from the key portion 60*b* satisfies Formula (2) makes the sum of the distance C and the play (B−A) between the fixation roller 7 and spacer 60 smaller than the external diameter A of the fixation roller 7. Therefore, it is ensured that the key portion 60*a* engages with the fixation roller 7 and remains engaged with the fixation roller. Therefore, it is ensured that the spacer 60 rotates with the fixation roller 7. In the first embodiment, C=39.1 mm. Thus, the sum of the distance C and the play (B−A) is 39.3 mm, which is smaller than the external diameter A (=40.0 mm) of the fixation roller 7. Therefore, the end portion of the key portion 60*b* remains protruding into the fixation roller 7 at least by 0.7 mm relative to the peripheral surface of the fixation roller 7, remaining thereby engaged with the fixation roller 7.

The thickness of the wall of the fixation roller 7 in the first embodiment is 0.6 mm, and the end portion of the key portion 60*a* of the spacer 60 remains protruding inward of the fixation roller 7 by at least 0.7 mm relative to the peripheral surface of the fixation roller 7. Therefore, the end portion of the key portion 60*a* remains protruding inward of the inward surface of the fixation roller 7 at least 0.1 mm, as shown in FIG. 6(*b*). Therefore, it is ensured that as the fixation roller 7 is rotated, the key portion 60*a* is hooked by the fixation roller 7. Therefore, it is ensured that as the fixation roller 7 is rotated, the spacer 60 rotates together with the fixation roller 7; it does not occur that as the fixation roller 7 is rotated, the spacer 60 becomes disengaged from the fixation roller 7.

Referring again to FIG. 6(*a*), in the first embodiment, a substantial amount (1.2 mm) of clearance is provided between the area of engagement between the key portion 60*a* of the spacer 60 and the C-shaped retaining ring 50*b*, and the blocking member 18. Therefore, even if the blocking member 18 moves, the key portion 60*a* and blocking member 18 do not interfere with each other, because the farthest distance by which the key portion 60*a* protrudes inward of the fixation roller 7 beyond the inward surface of the fixation roller 7 is (0.1+0.2) mm at most.

As described above, according to the structure of the fixation roller 7, structure of the auxiliary components for the fixation roller 7, and method for assembling them, the spacer 60 is placed between the C-shaped retaining ring 50*b* and thermal insulation bushing 70*b* to prevent the C-shaped retaining ring 50*b* and thermal insulation bushing 70*b* from directly contacting each other. That is, the fixation roller 7 and its auxiliary components are designed so that the C-shaped retaining ring 50*b* does not hang up in the slit 70*b* of the thermal insulation bushing 70*b*.

Further, the spacer 60 is locked to the fixation roller 7 by its key portion 60*a*. Therefore, the C-shaped retaining ring 50*b* and spacer 60 rotate together as they rotate with the fixation roller 7. Therefore, it does not occur that the C-shaped retaining ring 50*b* and spacer 60 rub against each other.

Further, the key portion 60*a* of the spacer 60 is fitted into one of the through holes 7*a* of the fixation roller 7, into which the inwardly protruding portions 50*e* of the C-shaped retaining ring 50*b* fit, one for one, making it even more unlikely for the C-shaped retaining ring 50*b* to disengage from the fixation roller 7.

Further, the thermal insulation bushing 70*b* is not attached to the fixation roller 7 in such a manner that it is not allowed to rotate around the fixation roller 7. Therefore, the thermal insulation bushing 70*b* and spacer 60 are allowed to slide upon each other. However, the surface of the spacer 60, which faces the thermal insulation bushing 70*b*, is flat and smooth, and therefore, the flange portion (lateral surface) of the thermal insulation bushing 70*b* is unlikely to be deteriorated by the friction between the spacer 60 and thermal insulation bushing 70*b*; this embodiment can prevent the problem that the thermal insulation bushing 70*b* is reduced in the length of its service life by the friction between the spacer 60 and thermal insulation bushing 70*b*.

<Embodiment 2>

Figure 10:
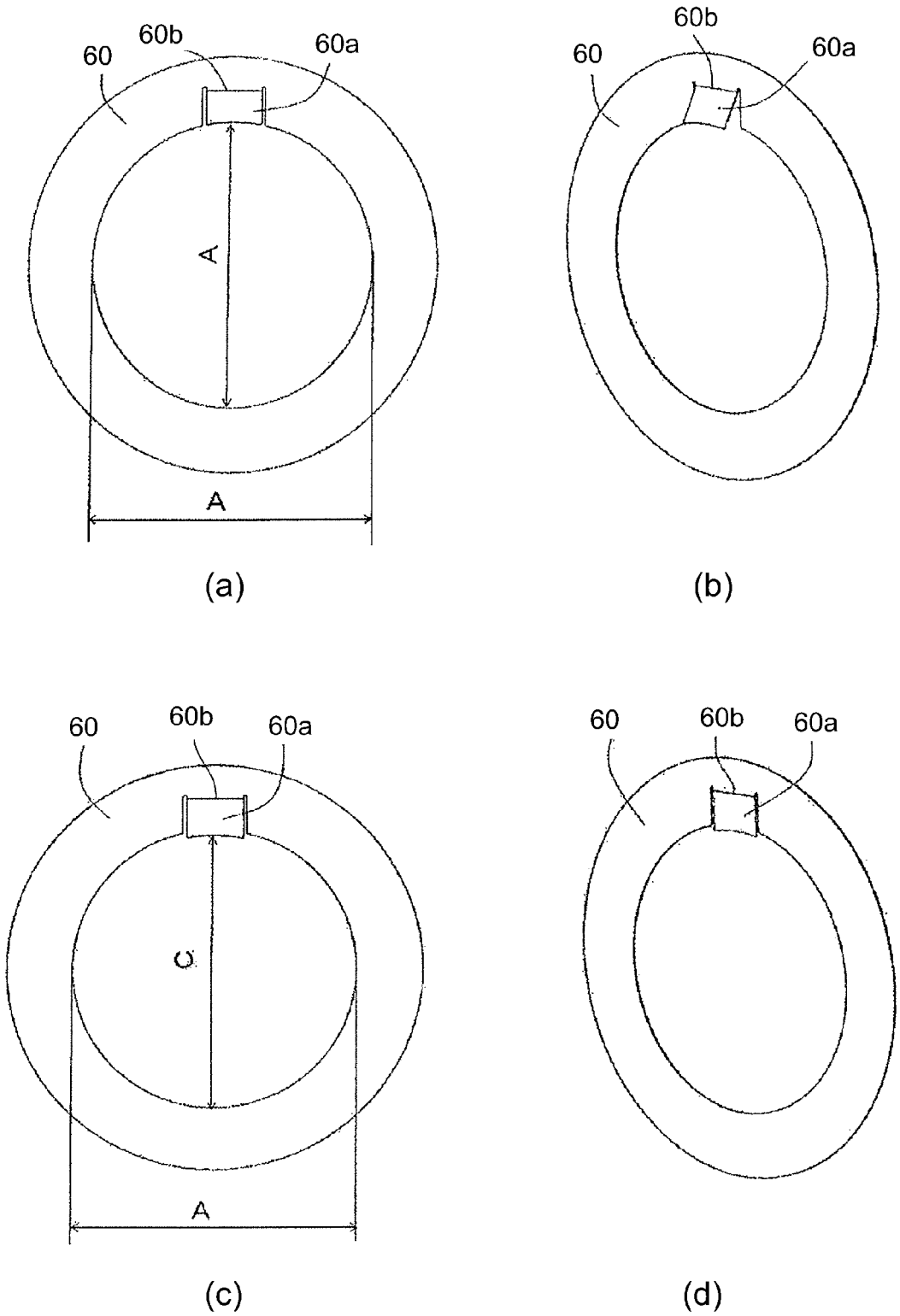
FIG. 10 is a drawing for describing the structure of the spacer in the second embodiment of the present invention.
Figure 11:
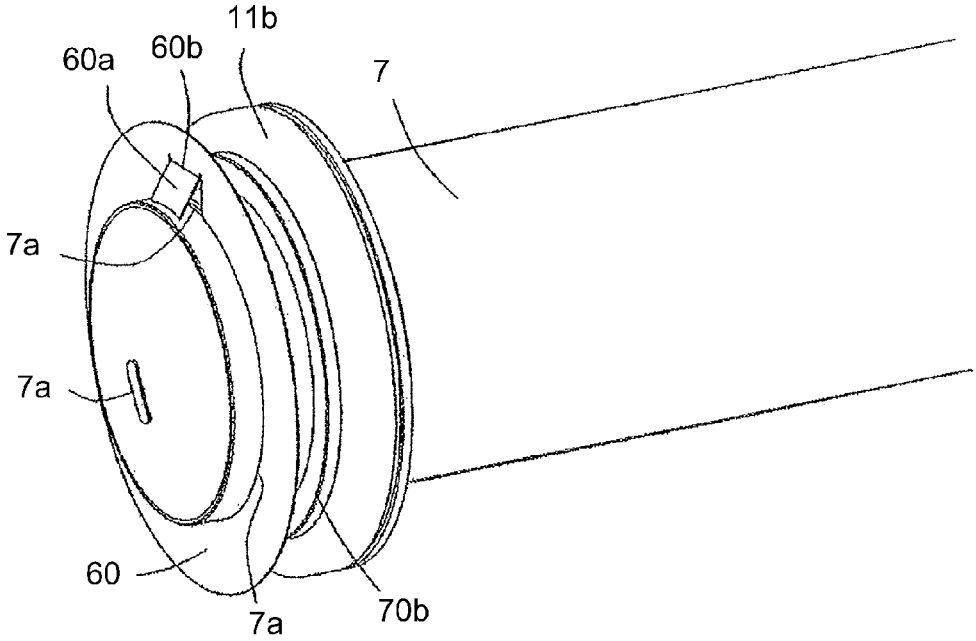
FIG. 11 is a drawing for describing the order in which the spacer is fitted around the fixation roller in this second embodiment.
Figure 11:
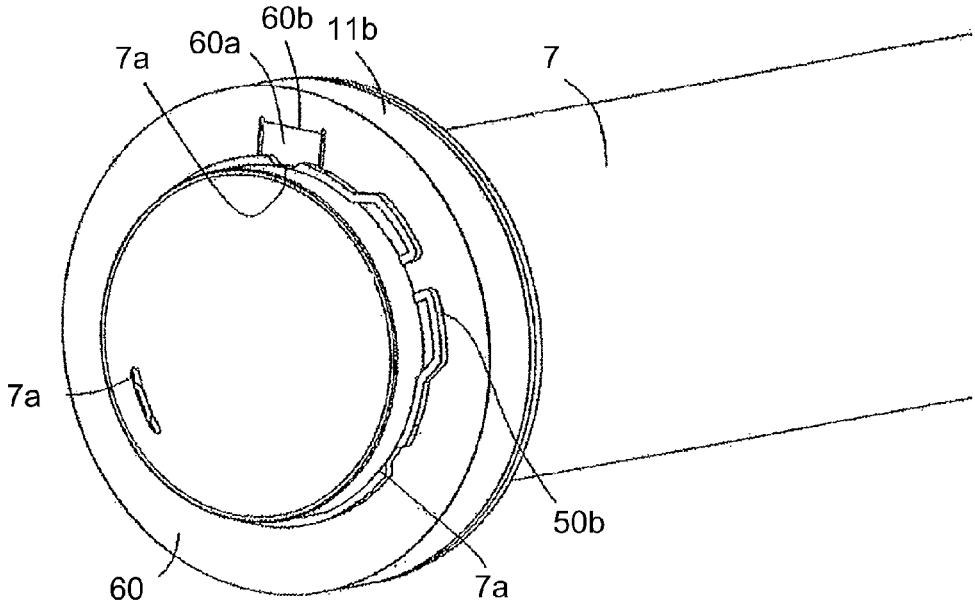

FIG. 10 is a drawing for describing the structure of the spacer 60 in the second embodiment of the present invention. FIG. 11 is a drawing for describing the order in which the spacer 60 is fitted around the fixation roller. The second embodiment is the same in structure and structural component of the fixing device as the first embodiment, except for the structure of the key portion of the spacer. Therefore, the structural components in this embodiment, which are shown in FIGS. 10 and 11 and are the same in structure as the counterparts in the first embodiment, are given the same referential codes as those given to the counterparts in FIGS. 5-9, and are not going to be described here, in order not to repeat the same descriptions.

Referring to FIG. 10(*a*), the key portion 60*a* of the spacer 60 in this embodiment is different from the counterpart in the first embodiment in that it is longer than the counterpart, in terms of the radius direction of the spacer 60, and also, that it is tilted relative to the circular main portion of the spacer 60. More specifically, the spacer 60 is provided with a couple of slits which extend a preset distance outward of the spacer 60 from the inward edge of the spacer 60 along the lateral edges of the key portion 60*a*. Thus, the key portion 60*a* in this embodiment can be easily bent. The material for the spacer 60 in this embodiment is a piece of springy thin plate of SUS, which is 0.2 mm in thickness, like the one in the first embodiment. Therefore, the base portion 60*b* of the key portion 60*a* is resilient (springy).

Therefore, the base portion 60*b* of the key portion 60*a* allows the key portion 60*a* to be resiliently tilted.

Referring again to FIG. 10(*a*) which is a frontal plan view of the spacer 60, the key portion 60*a* in the second embodiment can be tilted so that the projection of the end of the key portion 60*a* upon a plane coincidental to the surface of the spacer 60 becomes semicircular and the same in curvature as the internal edge of the spacer 60, the diameter of which is A, which is the same as the external diameter of the fixation roller 7. As described above, a pair of slits are provided which extend by a preset distance from the portions of the inward edge of the spacer 60, which correspond to the base portion of the key portion 60*a* in the first embodiment, toward the outward edge of the spacer 60, in parallel to the lateral edges of the key portion 60*a*.

Next, referring to FIG. 10(*b*), when the key portion 60*a* is bent 30°, the projection of the end of the key portion 60*a* of the spacer 60 upon the plane coincidental with the surface of the spacer 60 has such a curvature that equals the curvature of a circle which is 40 mm in diameter. When the spacer 60 is in its natural state, that is, when the spacer 60 is off the fixation roller 7, the angle of the key portion 60*a* relative to the circular main portion of the spacer 60 is 20°. Therefore, the curvature of the projection of the end of the key portion 60*a* of the spacer 60 upon the plane coincidental with the surface of the spacer 60 is less than the curvature of a circle which is 40 mm in diameter.

Next, referring to FIG. 10(*c*), the key portion 60*a* can be made level with the circular main portion of the spacer 60 by being reversely bent slightly at its base portion 60*b* between the key portion 60*a* and the circular main portion of the spacer 60. There is the following relationship between the length C from the end of the key portion 60*a* to the opposite point of the inward edge of the spacer 60 from the key portion 60*a*, and the external diameter A of the fixation roller 7: A>C. In this embodiment, A=40 mm and C=39.9 mm.

The spacer 60 in the second embodiment is fitted around the fixation roller 7 as shown in FIG. 11(*a*). As the key portion 60*a* is bent at the base portion 60*b*, the projection of the end of the key portion 60*a* upon the plane coincidental to the surface of the spacer 60 becomes the same in curvature as the fixation roller 7, which is A in external diameter. Therefore, after the spacer 60 is fitted around the lengthwise end of the fixation roller 7, it can be slid toward the area of the fixation roller 7 where the three through holes 7*a* are present. As the key portion 60*a* reaches the area of the fixation roller 7 where the through holes 7*a* are present, it is to be fitted into one of the three through holes 7*a*.

Referring to FIG. 11(*b*), next, the C-shaped retaining ring 50*b* is to be fitted around the fixation roller 7. After the key portion 60*a* is made level with the circular main portion of the spacer 60 as shown in FIG. 10(*d*), one of the three inwardly protruding portions 50*e* of the C-shaped retaining ring 50*b* is fitted into the through hole 70*a* in which the key portion 60*a* is already present. The other (two) inwardly protruding portions 50*e* of the C-shaped retaining ring 50*b* are fitted into the through holes 70*a* in which the key portion 60*a* is not present. That is, the three inwardly protruding portions 50*e* of the C-shaped retaining ring 50*b* are fitted into the three through holes 7*a* of the fixation roller 7, one for one, which are in alignment with each other in the circumferential direction of the fixation roller 7, with equal angular intervals (120°).

Also in the second embodiment, the thickness of the wall of the fixation roller 7 is 0.6 mm as in the first embodiment.

Therefore, the end portion of the key portion 60*a* protrudes inward of the fixation roller 7 by no less than 0.1 mm from the inward surface of the fixation roller 7. Thus, it is ensured that as the fixation roller 7 is rotated, the fixation roller 7 catches the key portion 60*a*, causing thereby the spacer 60 to rotate with the fixation roller 7 without allowing the spacer 60 to disengage from the fixation roller 7.

The second embodiment is different from the first embodiment in that the key portion 60*a* of the spacer 60 is springy and is angled relative to the circular main portion (main structure) of the spacer 60. Thus, the inward edge of the spacer 60, which includes the end portion of the key portion 60*a* is virtually circular. Therefore, the internal diameter of the spacer 60 is the same as the external diameter A of the fixation roller 7. Therefore, there is virtually no play between the inward surface of the spacer 60 and the peripheral surface of the fixation roller 7. Thus, the spacer 60 rotates with the fixation roller 7 while remaining more tightly in contact with the fixation roller 7 than the spacer 60 in the first embodiment. Incidentally, in the first embodiment, there is a play between the spacer 60 and fixation roller 7.

In the second embodiment, however, the spacer 60 has to be greater in external diameter than the spacer 60 in the first embodiment, because the key portion 60*a* of the spacer 60 in the second embodiment has to be long enough to be resiliently flexed. In other words, the second embodiment requires more space for the spacer 60 than the first embodiment. As a matter of fact, the external diameter of the spacer 60 in the second embodiment is 60 mm, which is greater than the external diameter of the spacer 60 in the first embodiment, which is 48.5 mm.

<Embodiment 3>

Figure 12:
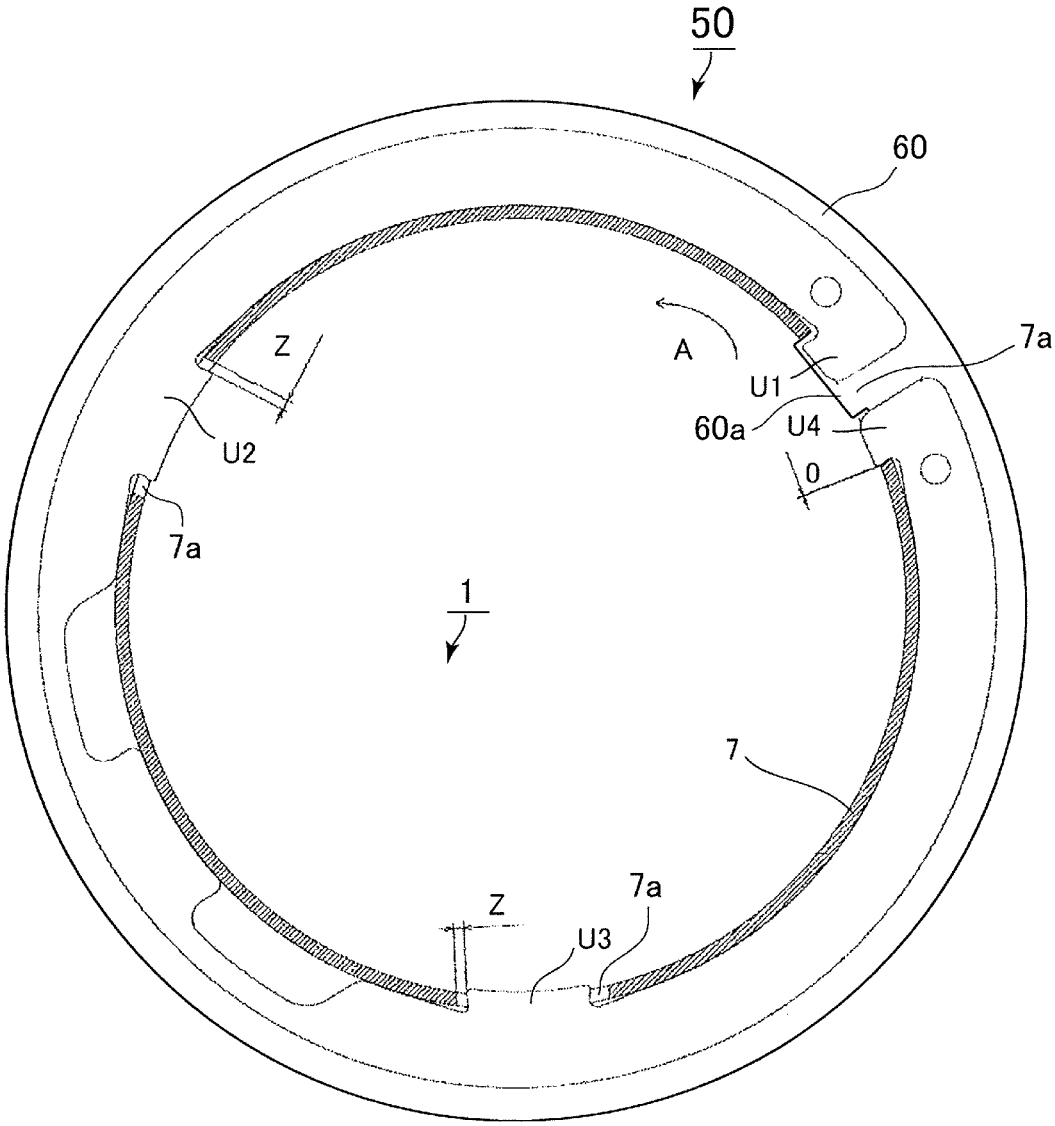
FIG. 12 is a plan view of the C-shaped retaining member in the third embodiment of the present invention.

FIG. 12 is a drawing for describing the C-shaped retaining ring 50*b* in the third embodiment of the present invention. The third embodiment is the same as the first embodiment, except for the contour of the C-shaped retaining ring. Therefore, the portions of the C-shaped retaining ring in the third embodiment, which are shown in FIG. 12 and are the same in structure as the counterparts in the first embodiments, are given the same referential codes as those given to the counterparts, and are not going to be described here, in order not to repeat the same descriptions.

Referring to FIG. 12 which is a plan view of the combination of the spacer 60, C-shaped retaining ring 50*b*, and fixation roller 7 in the third embodiment, as seen from the direction parallel to the axial line of the fixation roller 7, each of the lengthwise ends of the fixation roller 7 is provided with three through holes 7*a*, which are the same in length and width. In terms of the circumferential direction of the fixation roller 7, the three through holes 7*a* are 120° apart from each other. The C-shaped retaining ring 50*b* is provided with inward protrusions U1, U4, U2 and U3, which are engaged into the three through holes 7*a* of the fixation roller 7, to precisely position, and keep precisely positioned, the C-shaped retaining ring 50*b* relative to the fixation roller 7 in terms of the direction parallel to the axial line of the fixation roller 7. The spacer 60 is provided with a key portion 60*a*, which is to be placed in one of the three through holes 7*a* of the fixation roller 7, along with the inward protrusions U1 and U4, to precisely position the spacer 60 relative to the fixation roller 7 in terms of the circumferential direction of the fixation roller 7.

The C-shaped retaining ring 50*b* is springy and is structured so that it can be bent in such a way that the pair of its inward protrusions U1 and U4, which oppose each other, with presence of a gap between them, in terms of the circumferential direction of the C-shaped retaining ring 50*b*, are placed in contact with each other, or separated from each other. It is also provided with the inward protrusions U2 and U3 which are separated by 120° from each other, and are separated by 120° from the inward protrusions U1 and U4, respectively. The inward protrusions U1 and U4 of the C-shaped retaining ring 50*b* are placed together in one of the through holes 7*a* of the fixation roller 7, and the inward protrusions U2 and U3 are placed in the other two through holes 7*a*. That is, the C-shaped retaining ring 50*b* are held to the peripheral surface of the fixation roller 7 at three points.

The preceding embodiments of the present invention were described with reference to a fixing device which uses a heating method based on electromagnetic induction. However, the present invention is also effective even if it is applied to a fixing device which uses a halogen heater or the like as its heating means.

Further, the preceding embodiments were described with reference to the structure of the opposite end portion of the fixation roller 7 from the one to which the driving gear 20 is attached. However, the end portion of the fixation roller 7, to which the driving gear 20 is attached, may also be structured so that the spacer 60 is positioned inward side of the C-shaped retaining ring 50*b*.

Further, the present invention is also applicable to other heating device than a fixing device, as long as they are provided with a recording medium conveyance roller which heats recording medium while conveying the recording medium. For example, it is applicable to an uncurling device for improving recording medium in appearance, a gloss altering device for improving in gloss an image fixed to recording medium by reheating the image, a recording medium drying device for drying recording medium by heating the recording medium before the formation of an image on the recording medium, and the like device. Although the descriptions of the other heating devices in accordance with the present invention than those in the preceding embodiments are not given here, they are the same as the descriptions of the fixing device in the preceding embodiments, except that in the descriptions of the other heating devices than the fixing device in the preceding embodiments, a conveyance roller (which internally holds heating device) takes the place of the image heating roller (fixation roller) in the preceding embodiments.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 140349/2011 filed Jun. 24, 2011 which is hereby incorporated by reference.

What is claimed is:

1. An image heating apparatus comprising:

a hollow image heating roller having a through hole at one axial end portion side thereof;

a bearing fitted around said image heating roller;

a heat insulating bush fitted around said image heating roller between said image heating roller and said bearing;

a retaining ring fitted around said image heating roller and configured to retain the position of said heat insulating bush relative to said image heating roller in the axial direction, said retaining ring being provided with an inwardly protruded portion engageable with the through hole; and an annular spacer provided between said heat insulating bush and said retaining ring, said annular spacer being provided with an inwardly protruded key portion engageable with the through hole.

2. An apparatus according to claim 1, wherein said annular spacer covers said retaining ring to prevent said retaining ring from contacting said heat insulating bush.

3. An apparatus according to claim 1, wherein said image heating roller is provided with another through hole at the one end portion side, and said retaining ring is provided with another inwardly protruded portion engageable with said another through hole.

4. An apparatus according to claim 3, wherein said through holes are spaced at the regular intervals in a circumferential direction of said image heating roller.

5. An apparatus according to claim 1, wherein said through hole is a slit extending in a circumferential direction of said image heating roller, and said key portion extends along the circumferential direction correspondingly to the configuration of said slit.

6. An apparatus according to claim 1, wherein said annular spacer has an elliptical inner periphery, and said key portion is provided at one end portion side of a major diameter of the inner periphery.

7. An apparatus according to claim 1, further comprising an excitation coil, provided in a hollow portion of said image heating roller, configured to perform electromagnetic induction heating of said image heating roller.

8. An apparatus according to claim 1, further comprising a driving gear provided at another axial end portion side of said image heating roller with respect to the axial direction of said image heating roller.

9. An image heating apparatus comprising:

a hollow cylindrical image heating member having a through hole at one end portion side with respect to an axial direction thereof;

a bearing member fitted around said image heating member;

a heat insulating member fitted around said image heating member between said image heating member and said bearing member;

an annular preventing member fitted around said image heating roller and configured to prevent said heat insulating member from moving relative to said image heating member in the axial direction, said annular preventing member being provided with an inwardly protruded portion engageable with said through hole; and an annular spacer member provided between said heat insulating member and said annular preventing member, said annular spacer member being provided with an inwardly protruded engaging portion engageable with said through hole.

10. An apparatus according to claim 9, wherein said annular spacer member covers said annular preventing member to prevent said annular preventing member from contacting said heat insulating member.

11. An apparatus according to claim 9, wherein said image heating member is provided with another through hole at the one end portion side, and said annular preventing member is provided with another inwardly protruded portion engageable with said another through hole.

12. An apparatus according to claim 11, wherein said through hole is a slit extending in a circumferential direction of said image heating member, and said key portion extends along the circumferential direction correspondingly to the configuration of said slit.

13. An apparatus according to claim 9, wherein said through hole is a slit extending along a circumferential direction of said image heating member, and said engaging portion extends along the circumferential direction of said image heating member correspondingly to the configuration of said slit.

14. An apparatus according to claim 9, wherein said annular spacer has an elliptical inner periphery, and said engaging portion is provided at one end portion side of a major diameter of the inner periphery.

15. An apparatus according to claim 9, further comprising an excitation coil, provided in a hollow portion of said image heating member, configured to perform electromagnetic induction heating of said image heating member.

16. An apparatus according to claim 9, further comprising a driving gear provided at another end portion side of said image heating member with respect to the axial direction of said image heating member.

17. A recording material feeding device comprising:

a recording material feeding member having a through hole at one end portion side with respect to an axial direction thereof;

a bearing member fitted around said recording material feeding member;

a heat insulating member fitted around said recording material feeding member between said recording material feeding member and said bearing member;

an annular preventing member fitted around said recording material feeding member and configured to prevent said heat insulating member from moving in the axial direction relative to said recording material feeding member, said annular preventing member being provided with an inwardly protruded portion engageable with the through hole; and an annular spacer member provided between said heat insulating member and said annular preventing member, said annular spacer member being provided with an inwardly protruded engaging portion engageable with said through hole.

18. An apparatus according to claim 17, further comprising a heating device, provided inside of said recording material feeding member, configured to heat said recording material feeding member.

19. An apparatus according to claim 17, further comprising a driving gear provided at another end portion side of said recording material feeding member with respect to the axial direction of said recording material feeding member.

20. An apparatus according to claim 1, wherein said retaining ring has end portions in a circumferential direction thereof.

21. An apparatus according to claim 9, wherein said annular preventing member is a ring-like member having end portions in a circumferential direction thereof.

22. An apparatus according to claim 17, wherein said annular preventing member is a ring-like member having end portions in a circumferential direction thereof.

* * * * *